United States Patent [19]

Byers

[11] Patent Number: 4,466,588

[45] Date of Patent: Aug. 21, 1984

[54] OPTICAL FIBER TRAVEL DIRECTION INDICATOR FOR MODEL RAILROADS

[75] Inventor: J. Hal Byers, 206 W. Southcross, San Antonio, Tex. 78221

[73] Assignee: J. Hal Byers, San Antonio, Tex.

[21] Appl. No.: 390,198

[22] Filed: Jun. 21, 1982

[51] Int. Cl.[3] ..... B61L 25/08

[52] U.S. Cl. ..... 246/122 A; 116/202; 246/1 C; 340/815.31; 340/990; 350/96.1

[58] Field of Search ..... 246/122 R, 122 A, 1 C, 246/3; 116/35 R, 202, 36; 350/96.1; 340/23, 24, 525, 286 M, 815.31, 989, 990, 995; D10/65; 40/547

[56] References Cited

U.S. PATENT DOCUMENTS

| | | | |
|---|---|---|---|
| 1,998,178 | 4/1935 | Wallace | 246/122 A |
| 3,388,371 | 6/1968 | McLean | 116/202 |
| 3,518,666 | 6/1970 | Heggestad | 340/815.31 |
| 3,611,359 | 10/1971 | Panerai et al. | 350/96.1 |
| 3,758,197 | 9/1973 | Klang et al. | 350/96.1 |
| 4,045,794 | 8/1977 | Ohta | 340/815.31 |

*Primary Examiner*—Robert B. Reeves
*Assistant Examiner*—Donald T. Hajec

[57] ABSTRACT

This travel direction indicator is for model railroads, and serves to indicate the direction a model train will travel on a track. Primarily, it consists of a pair of spaced-apart optical fiber rods, each having arrow head like indentations, the group on one rod facing in one direction and the other group, of the other rod, facing in the opposite direction. It further includes a panel for mounting the rods, and a switch is coupled to a pair of bulbs in the panel to illuminate each rod selectively, which will indicate the direction a train will travel, by the lighting up of the arrow-like indentations.

1 Claim, 4 Drawing Figures

OPTICAL FIBER TRAVEL DIRECTION INDICATOR FOR MODEL RAILROADS

This invention relates to optical fiber devices, and more particularly, to an optical fiber travel direction indicator for model railroads.

The principal object of this invention is to provide an optical fiber travel direction indicator for model railroads, which will be unique and novel.

Another object of this invention is to provide an optical fiber directional indicator for model railroads, which will, by scored panel means, indicate the direction a model train will travel.

Another object of this invention is to provide an optical fiber travel direction indicator, which will be connected to the control panel of a model railroad.

A further object of this invention is to provide an optical fiber travel direction indicator for model railroads, which will employ the use of a bulb at each end of the panel, that will light by power received from the control panel of the railroad.

Other objects are to provide an optical fiber travel direction indicator for model railroads, which is simple in design, inexpensive to manufacture, rugged in construction, easy to use, and efficient in operation.

These, and other objects, will be readily evident, upon a study of the following specification, and the accompanying drawing, wherein.

Figure 1:
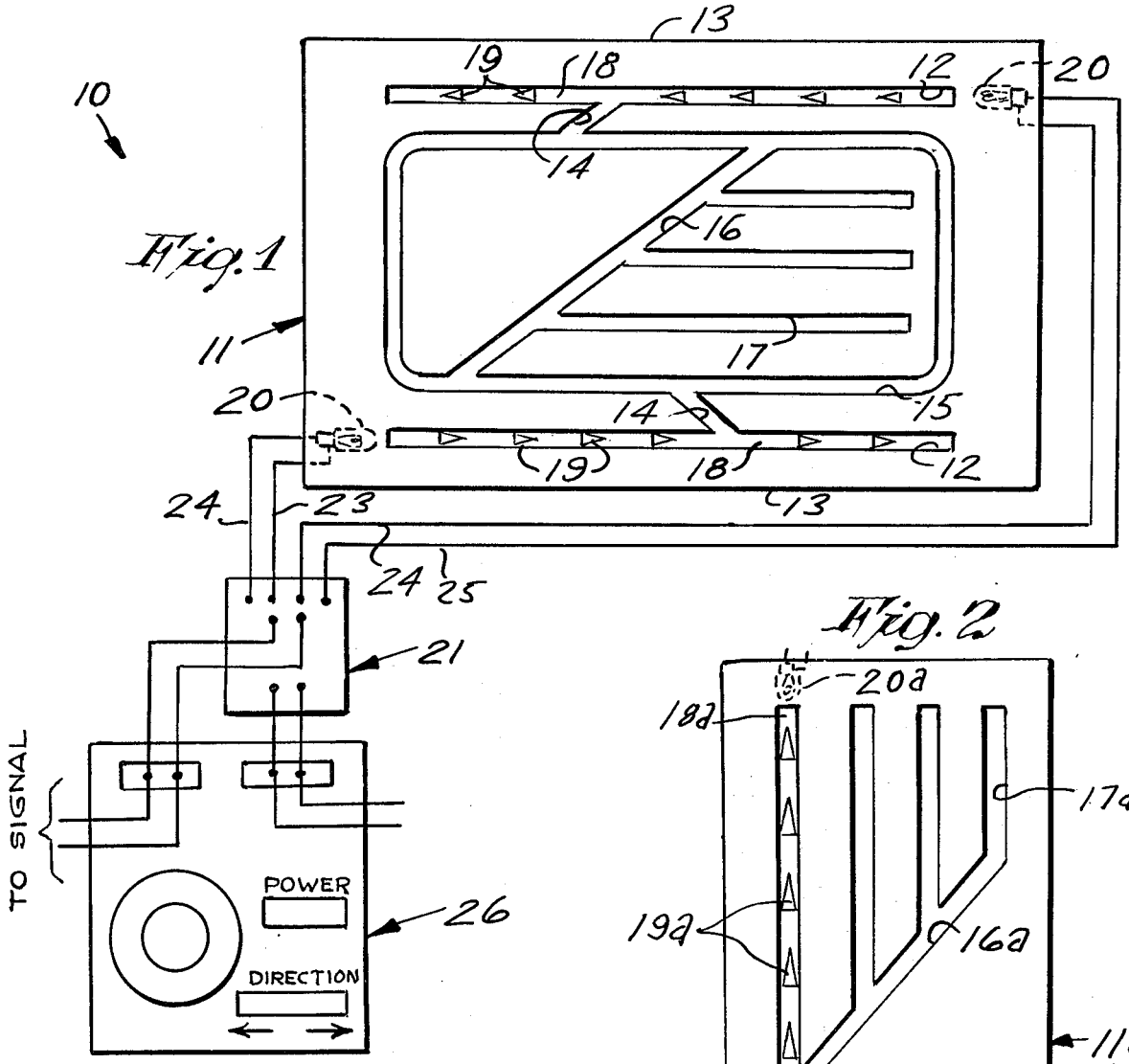
FIG. 1 is a schematic diagram of the present invention.

According to this invention, a travel direction indicator 10 is shown to include a rectangular configurated panel 11, having cut-out openings 12 adjacent to, and spaced from, the longitudinal side edges 13, along with other cut-out openings 14, 15, 16, and 17. Within each opening 12 is secured, in a suitable manner, an optical fiber rod 18, which is coated with black enamel, prior to being scored with a plurality of triangular indentations or recessed areas 19, which are spaced from each other to emit light in the form of arrows, for indicating the direction of traffic of trains, when power is supplied to the bulbs 20.

It shall be noted, that the bulbs 20 are suitably secured within panel 11, and two panels 11 are required for each section of track.

Each bulb 20 is in alignment with an end of optical fiber rods 18, and each is wired to double pole-double throw switch 21, by wires 22, 23, 24, and 25 respectively, and switch 21 wired to the control panel 26, which is common in the art.

In use, when the switch 21 is thrown in either direction, one of the bulbs 20 will light, which will cause one of the respective groups of indentations 19 to glow with the light transmitted thereto, and indicate, by their arrow shape, the direction the model train will travel.

It is to be understood that the pattern of the cut-out openings represents a layout of a specific model railroad, and may, accordingly, be made of endless variations in pattern design, of which the one illustrated in FIG. 1 is only one example. In the design shown in FIG. 1, the cut-out 15 may represent a main line travel circuit of a railroad system, and the plurality of parallel cut-outs 17, together with their joining cut-out 16, may represent a railroad yard where trains of railroad cars are assembled together. The pattern may be made with any other number of optical fibers than shown in FIG. 1, and they may be located anywhere in the system, other than shown. Likewise, the switch 21 and control panel 26 may or may not be included as shown.

Figure 2:
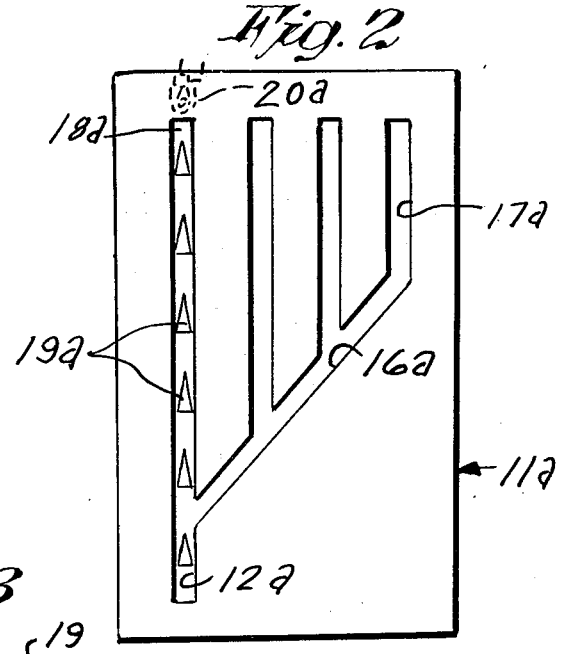
FIG. 2 is a plan view of a modified form of panel, employing the optical fiber principle.
Figure 3:
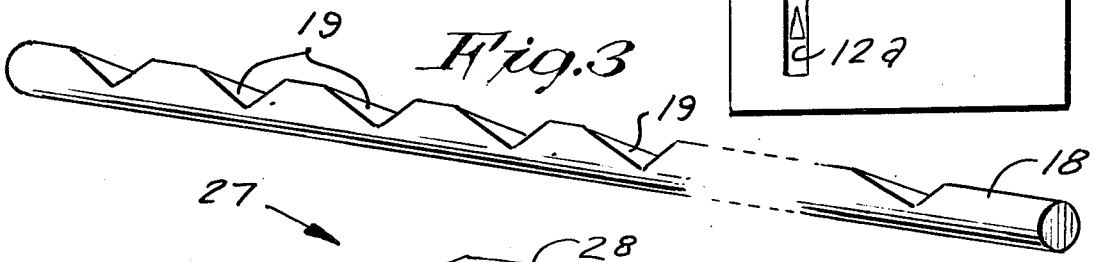
FIG. 3 is an enlarged perspective view of one of the optical fiber members, shown removed from the invention.

Referring to FIG. 2, a modified indicator panel 11*a* is similar to panel 11, and includes openings 12*a*, 16*a*, and 17*a*. An optical fiber rod 18*a* is secured in opening 12*a*, and also includes areas 19*a*, similar to 19 of rods 18, and a bulb 20*a* is received in panel 11*a* for the illumination effect of areas 19*a*.

In use, panel 11*a* functions in the same manner as was heretofore described of panel 11 of indicator 10, with the exception that the layout is different.

Figure 4:
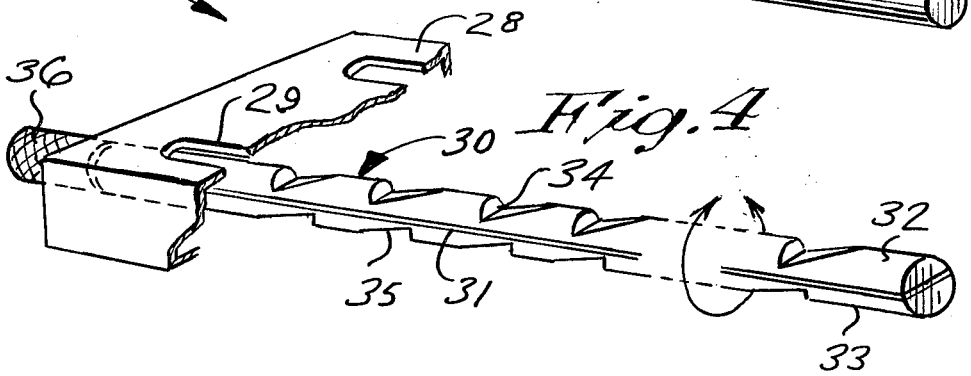
FIG. 4 is a fragmentary perspective view of a modified form of panel construction.

Looking now at FIG. 4 of the drawing, a modified panel structure 27 is shown to include a hollow panel 28, having openings 29 therethrough. An optical fiber rod 30 is shown to include an opaque divider strip 31, which is fixedly secured to two strips 32 and 33 of optical fiber quality by suitable adhesive means. Strip 32 is provided with arrow-shaped indentations 34, and strip 33 is provided with similar indentations 35 scored in the opposite direction, for indicating the direction a train will travel. A knurled knob 36, on the extending end of rod 30, serves to enable the user to rotate rod 30, so as to expose either arrow indentations 34 or 35, which are cut or scored in opposite directions. Light is supplied to rod 30 by a bulb at its opposite end, which is not shown.

In use, modified structure 27 functions in the same aforementioned manner, as was described of indicator 10, with the exception, that visual direction indication is performed by rotating rod 30 one hundred and eighty degrees by knob 26 means.

While various changes may be made in the detail construction, it is understood that such changes will be within the spirit and scope of the present invention, as is defined by the appended claims.

What I now claim is:

1. An optical fiber travel direction indicator for model railroads, comprising, in combination, a panel, a pattern of cut-outs made in said panel representing a layout of a model railroad, and at least one optical fiber being positioned within a portion of said pattern of cut-outs, said optical fiber comprising an elongated, cylindrical rod, a black enamel coating an entire surface of said rod except at portions of light entry thereinto and light exit therefrom, said light entry comprising one end of said rod and said light exit comprising a plurality of uncoated areas in the shape of arrows along a side of said rod, an electric lamp within said panel being adjacent said rod end, said lamp being in an electric power circuit; and said rod being made from two semi-cylindrically-shaped optical fiber members and an opaque divider strip therebetween, one said member having a row of said arrows all pointing into one direction and the other said member having a row of said arrows all pointing into an opposite direction, a knurled knob on an opposite end of said rod protruding outwardly from an edge of said panel for manual rotation of said rod in order for selective display of said members from the front side of said panel.

* * * * *